US008944413B1

(12) United States Patent
Hatch et al.

(10) Patent No.: US 8,944,413 B1
(45) Date of Patent: Feb. 3, 2015

(54) SOLAR-POWERED BOAT LIFT

(71) Applicants: Gary L. Hatch, Germfask, MI (US); James Hatch, Germfask, MI (US)

(72) Inventors: Gary L. Hatch, Germfask, MI (US); James Hatch, Germfask, MI (US)

( * ) Notice: Subject to any disclaimer, the term of this patent is extended or adjusted under 35 U.S.C. 154(b) by 10 days.

(21) Appl. No.: 13/841,154

(22) Filed: Mar. 15, 2013

(51) Int. Cl.
*B66D 1/00* (2006.01)
*B66D 1/12* (2006.01)

(52) U.S. Cl.
CPC ..... *B66D 1/12* (2013.01)
USPC ..... 254/323; 405/3; 405/7

(58) Field of Classification Search
USPC ..... 254/323; 114/45, 44, 46, 47, 48; 405/1, 405/3, 4, 7
See application file for complete search history.

(56) References Cited

U.S. PATENT DOCUMENTS

| | | | | |
|---|---|---|---|---|
| 3,210,049 | A * | 10/1965 | Holsclaw | 254/323 |
| 3,460,696 | A * | 8/1969 | Owen, Jr. | 414/483 |
| 3,948,488 | A * | 4/1976 | Brockelsby | 254/323 |
| 3,970,203 | A * | 7/1976 | Watson, Jr. | 414/538 |
| 4,763,592 | A * | 8/1988 | Russ | 114/45 |
| D306,415 | S * | 3/1990 | Godbersen | D12/106 |
| 4,954,011 | A | 9/1990 | Stenson | |
| 5,211,124 | A | 5/1993 | Reiser | |
| 5,281,077 | A * | 1/1994 | Phillips | 414/678 |
| 5,509,639 | A * | 4/1996 | Ellis | 254/380 |
| 5,615,785 | A * | 4/1997 | Kaner | 212/180 |
| 5,908,264 | A | 6/1999 | Hey | |
| 6,086,083 | A * | 7/2000 | Wilks | 280/479.1 |
| 6,543,375 | B1 * | 4/2003 | Sargent et al. | 114/45 |
| 6,578,823 | B1 * | 6/2003 | Johnson | 254/334 |
| 6,695,688 | B1 * | 2/2004 | Owen et al. | 452/187 |
| 7,017,887 | B1 | 3/2006 | Verakis | |
| 7,226,041 | B2 * | 6/2007 | Ledford | 254/342 |
| 7,637,690 | B2 * | 12/2009 | Stanley | 405/3 |
| 7,784,767 | B2 | 8/2010 | Gargaro, III et al. | |
| 8,267,620 | B2 * | 9/2012 | Wood et al. | 405/3 |
| 2003/0189312 | A1 * | 10/2003 | McNamee | 280/414.1 |
| 2006/0169961 | A1 * | 8/2006 | Ledford | 254/342 |
| 2010/0104365 | A1 | 4/2010 | Wood, II et al. | |
| 2011/0181018 | A1 * | 7/2011 | Bruneau | 280/414.1 |
| 2011/0236174 | A1 * | 9/2011 | Escher | 414/803 |
| 2012/0305052 | A1 * | 12/2012 | Bruneau | 136/246 |

OTHER PUBLICATIONS

Craftlander. 10 Watt 12v Solar Charging Kit. http://www.boatliftand-dock.com/p-199-10-watt-12v-solar-charging-kit.aspx Accessed Jun. 6, 2012.

* cited by examiner

*Primary Examiner* — Emmanuel M Marcelo
(74) *Attorney, Agent, or Firm* — Robert C. Montgomery; Montgomery Patent & Design

(57) ABSTRACT

A solar-powered boat winch suited for installation upon boat lifting structures such as those in a remote location. The solar powered boat winch includes an electric motorized winch, a solar cell, a rechargeable battery, a recharger, and mechanical mounts for attaching the solar powered boat winch to a boat lift structure. The solar cell collects sufficient solar energy and converts it into electricity that charges the rechargeable battery. The rechargeable battery acts as the power source for an electric motor of the winch. The winch assembly also includes remote controlled operation.

20 Claims, 3 Drawing Sheets

SOLAR-POWERED BOAT LIFT

RELATED APPLICATIONS

There are no current co-pending applications.

FIELD OF THE INVENTION

The present invention is directed towards boat winches. More particularly, the present invention is directed to remote controlled, solar powered boat lifting winches.

BACKGROUND OF THE INVENTION

There are numerous types of small water craft on the waters today. For example, small boats, jet skis, pontoon boats, row boats, power boats and the like. Such small water craft are very popular, relatively low cost, widely available, and widely used. However, in general they require protection and maintenance. To provide protection and maintenance such water craft must be taken out of the water.

Small water craft are frequently removed from the water by boat lifts. Boat lifts remove water craft from the water in a manner that protects the water craft's hull from damage to enable maintenance, transportation, and storage of the water craft. Most boat lifts are either hand-operated or operated by electric power that is supplied by power lines. Hand-operated systems use a hand-crank to power cables and pulleys that raise or lower the water craft. Operating a boat lift by hand quickly becomes tiring for all but those in peak physical shape. In particular, elderly, handicapped, the very young, and others may simply find hand cranking too difficult.

The alternative to hand operated boat lifts are electric powered boat lifts. Such boat lifts require the availability of electrical power. Since some boat lifts are located far from power lines the use of electrical-powered boat lifts can be problematic. Running electric power to remotely located boat lifts may be far too costly and difficult to be practical. Indeed, in some remote locations, such as in wilderness areas, running power lines is not possible no matter what the cost.

Accordingly, there exists a need for boat lifts that can be used in remote locations without requiring electrical power lines and without required hand powered operation. Beneficially, those boat lifts would be electrically operated, would be low cost, easy to use and easy to install. Preferably such boat lifts would provide safe, "green" energy methods of raising and lowering water craft.

SUMMARY OF THE INVENTION

The principles of the present invention provide for electric-powered boat lifts that can be used in remote locations without requiring electrical power lines or hand-powered operation. Beneficially, such boat lifts can provide a safe, "green" energy method of raising and lowering water craft.

The principles of the present invention provide for a solar-powered lift mechanism that uses a small solar panel and regulator to charge a deep-discharge rechargeable battery. Electric power from the battery is selectively used to power a DC motor that raises and lowers the boat lift. The invention is perfect for remote locations where conventional power sources are not readily available.

A solar-powered boat winch that is in accord with the present invention includes a winch assembly having a gear reducer, an electric motor that rotates the gear reducer and a gear pulley that is turned by the gear reducer. A winch bracket is attached to the winch assembly. The winch bracket itself is configured to attach to an external structure. A battery provides electric power to the electric motor while a switch selectively switches the electric power from the battery to the electric motor. A solar panel having a solar cell produces electrical power which is regulated by a voltage regulator and used to charge the battery.

Beneficially the battery is located inside a battery box assembly that includes a protective enclosure. The protective enclosure includes an access panel and a weather seal so as to provide a sealed box. The battery box assembly further includes a support tray that is attached to a battery tray bracket that is configured to mount to an external structure.

In practice there is a cable wound on the gear pulley while the switch supplies electric power to the electric motor so as to selectively rotate the electric motor in either direction. Preferably the switch is a rocker switch while the battery is a deep-cycle 12-volt battery. In addition to the switch the solar-powered boat winch may include a remote control for remotely controlling the winch assembly and a control module for energizing the electric motor based on input from the switch or from the remote control. A receiver receiving the signals from the remote control and applies control signals to the control module. For convenience the remote control is a fob.

The receiver may be affixed to the battery enclosure while the solar panel may be attached to a swivel mount. In practice the winch bracket may be welded to the gear reducer. To mount the solar-powered boat winch the winch bracket may include at least two (2) first bracket ears that are configured to fit around an external structure. At least one (1) of the bracket ears may include an aperture for receiving a fastener. In use the solar-powered boat winch can includes at least one (1) rigging that receives the cable. For example, the rigging may be a rigging pulley.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
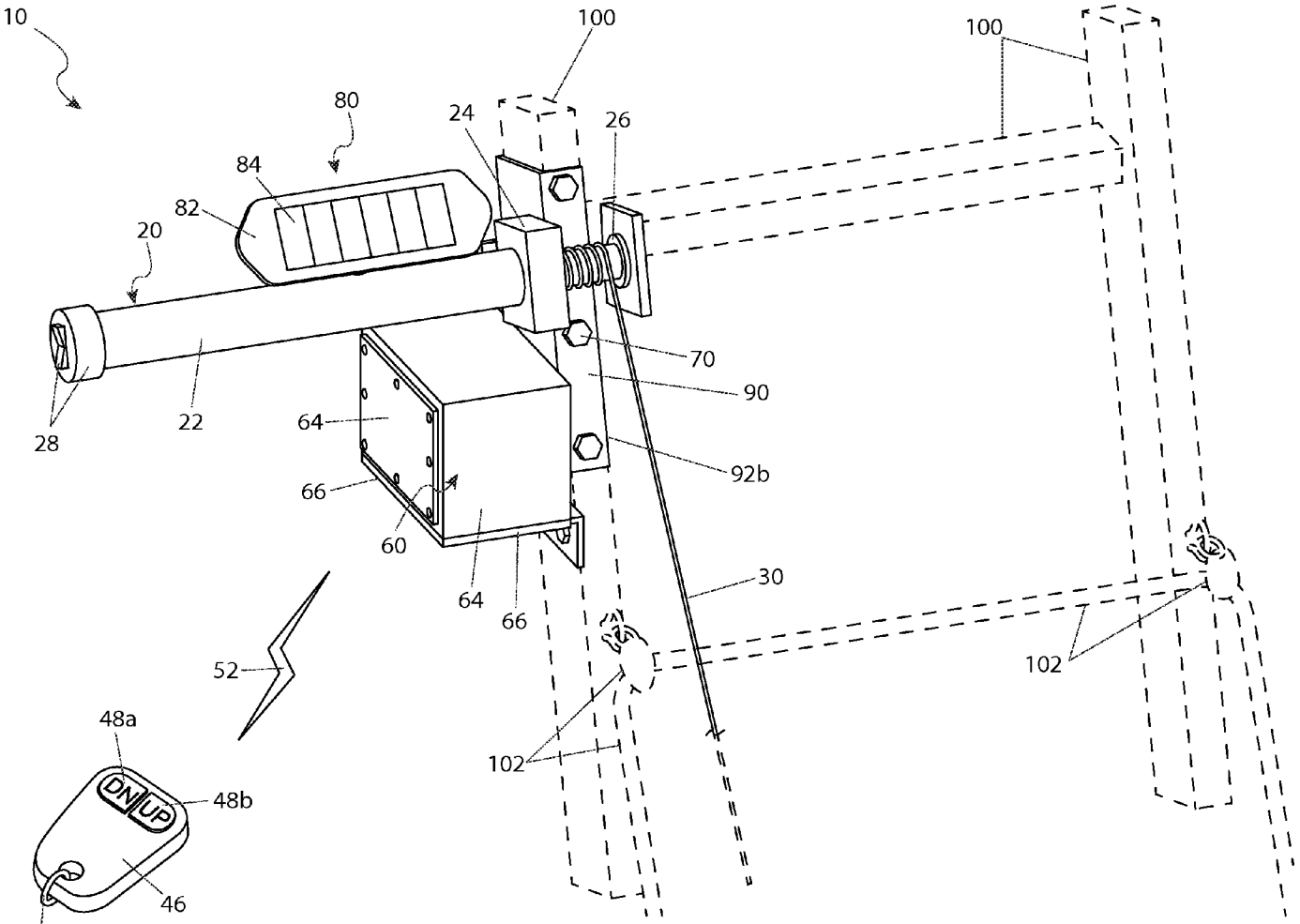
FIG. 1 is a front perspective view of a solar-powered boat winch 10 that is in accord with the principles of the present invention.

10 solar-powered boat winch
20 winch assembly
22 motor
24 gear reducer
26 pulley
28 lift switch
30 cable
40 control module
42 receiver
44 antenna
46 remote control device
48*a* first button
48*b* second button
50 ring
52 signal

60 battery box assembly
61 battery
62 enclosure
64 access panel
65 gasket
66 tray
67 battery tray bracket
70 fastener
80 solar panel
82 housing
84 solar cell
86 swivel mount
90 winch bracket
92*a* first bracket ear
92*b* second bracket ear
100 boat lifting structure
102 rigging equipment
105 wiring

DETAILED DESCRIPTION OF THE PREFERRED EMBODIMENT

Figure 2:
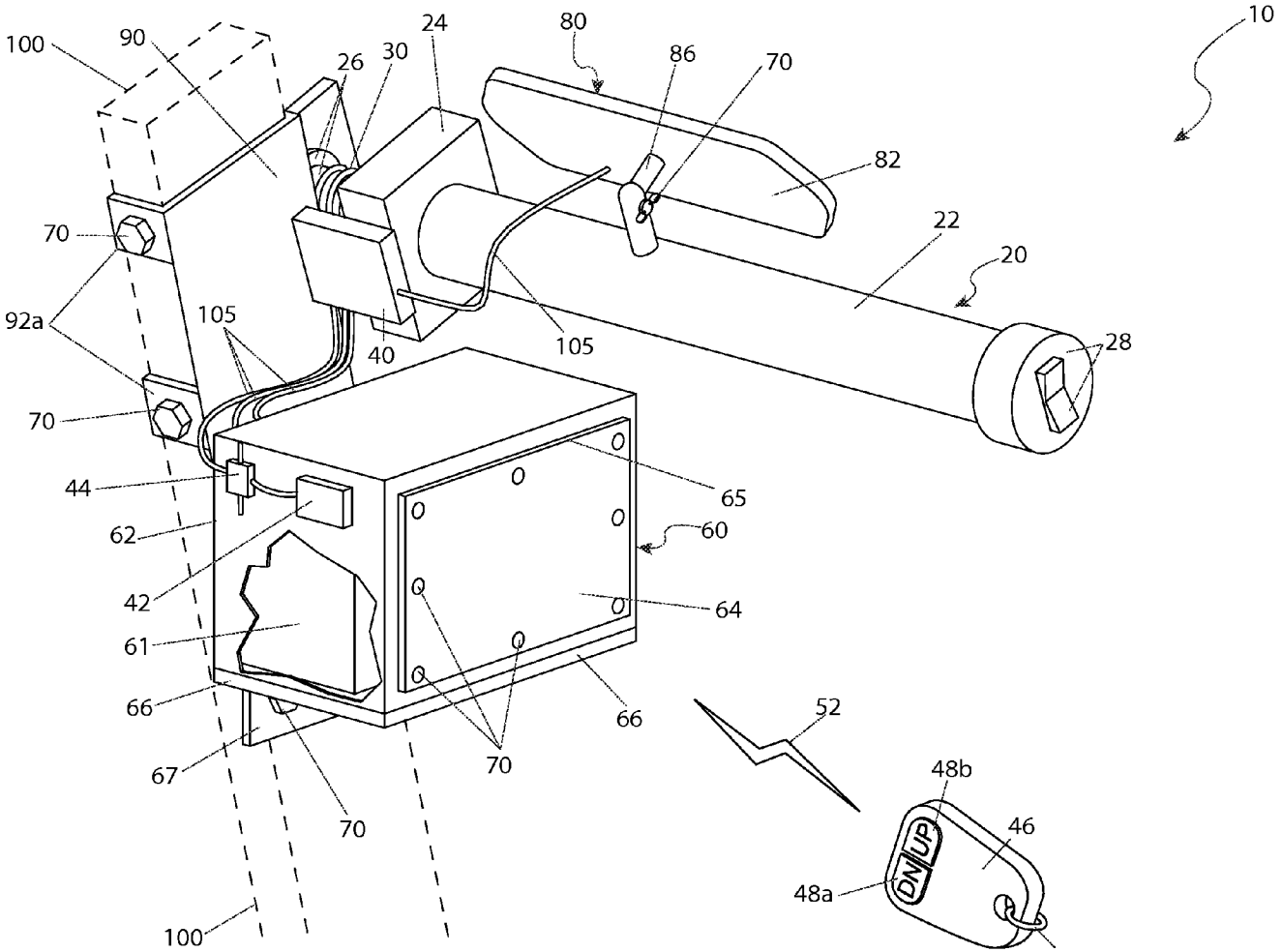
FIG. 2 is a rear perspective view of the solar-powered boat winch 10 shown in FIG. 1; and, FIG. 3 is an electrical block diagram of the solar-powered boat winch 10 shown in FIGS. 1 and 2.
Figure 3:
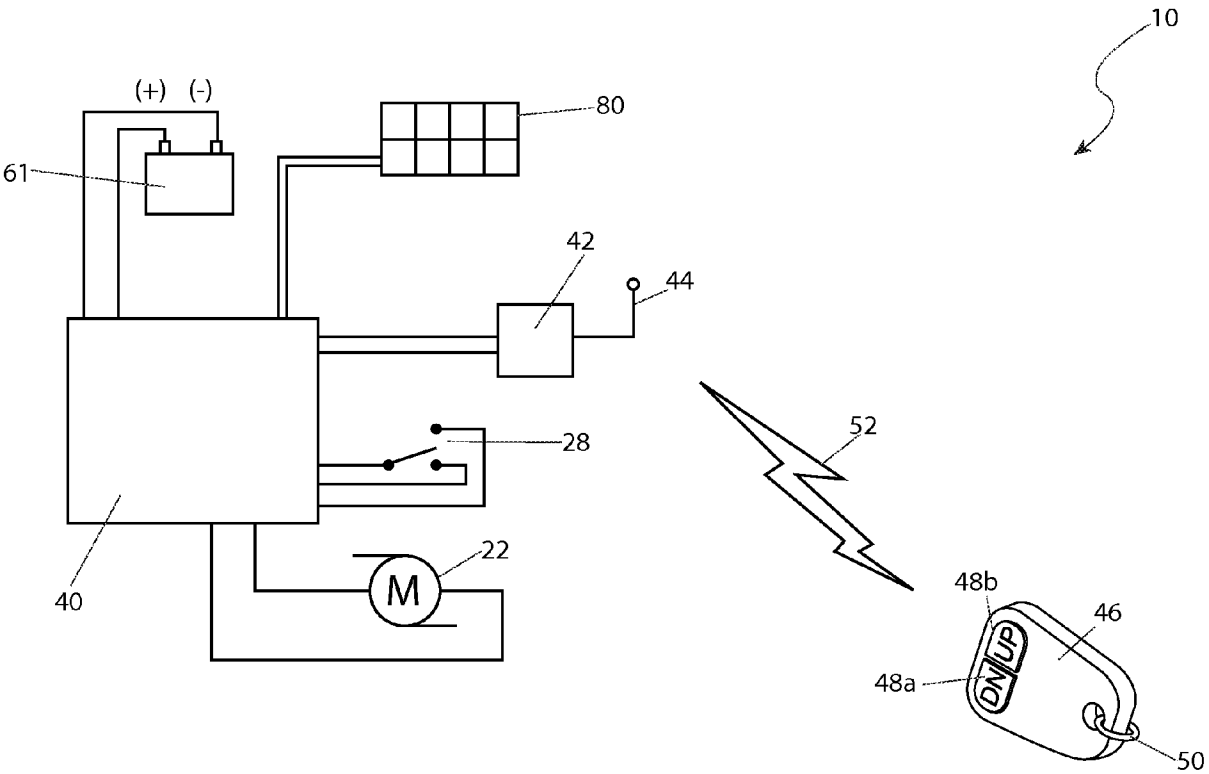

The best mode for carrying out the invention is presented in terms of its preferred embodiment, herein depicted within FIGS. 1 through 3. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes a solar-powered boat winch 10 that is shown in FIGS. 1-3. The solar-powered boat winch 10 includes a cable-driven winch assembly 20 for raising and lowering water craft such as motor boats, pontoon boats, jet skis, and the like from an existing boat lift 100. The cable-driven winch assembly 20 is powered by electricity produced by a solar panel 80. The solar powered boat winch 10 is designed to replace either a hand crank winch assembly or an electric winch that is designed to be powered via a conventional 110-volt power source. Consequently, the solar-powered boat winch 10 is particularly useful in remote locations where conventional power sources are not readily available. Additionally, for safety and convenience the solar-powered boat winch 10 supports operation using a hand-held remote control 46.

While the solar-powered boat winch 10 is a very useful replacement for existing boat lift devices, the solar-powered boat winch 10 is also well suited for new cable-driven boat lifts 100, either standard or as optional equipment.

FIGS. 1 and 2 provide perspective views of the solar powered boat winch 10 which in accord with the preferred embodiment of the present invention. The solar-powered boat winch 10 comprises the winch assembly 20, a winch bracket 90, a battery box assembly 60, and the solar panel 80. The solar panel 80 provides electrical power to charge an on-board battery 61, which in turn powers a DC motor 22 which operates the cable winch assembly 20. The DC motor 22 can selectively raise and lower water craft using the existing boat lift structure 100. In practice the winch assembly 20 is configured to be rigidly affixed to the boat lift 100 by the winch bracket 90.

The winch assembly 20 is beneficially a 12-volt motorized unit envisioned as capable of applying a minimal force of approximately two-thousand pounds (2000 lb.) upon an extended cable 30. The cable 30 is attached to various riggings 102 of the boat lift 100, such as pulleys, cables, and the like, to lift or lower the boat lift 100. The winch assembly 20 is envisioned as being somewhat similar to commercially-available cable-driven units. The winch assembly 20 includes the DC motor 22, a gear reducer 24, a cable pulley 26 suitable for winding up a length of marine-grade cable 30, and a 3-position rocker-type lift switch 28. The solar powered boat winch 10 further comprises an electronic control module 40.

As previously noted the winch assembly 20 is securely attached to the boat lift 100 via an integral winch bracket 90. The winch bracket 90 is welded to, or otherwise affixed to the gear reducer 24. The winch bracket 90 comprises a large, generally flat metal plate that provides an attachment to the remainder of the solar-powered boat winch 10. The winch bracket 90 includes a pair of first bracket ears 92*a* and a pair of second bracket ears 92*b* that wrap around opposing parallel sides of a stationary member of the boat lift 100. The bracket ears 92*a*, 92*b* are envisioned being secured to the boat lift 100 using a plurality of fasteners 70 such as lag screws, bolts, or the like. However, should be understood that the solar-powered boat winch 10 may be introduced with winch brackets 90 that are designed to fit snuggly to various appendages of different boat lifting structures 100. Thus the illustrated winch bracket 90 may be modified as required to fit on different boat lifting structures 100.

The battery 61 is well protected within the battery box assembly 60. The battery box assembly 60 beneficially includes a rectangular plastic or metal enclosure 62, an access panel 64, a support tray 66, and a battery tray bracket 67. The battery box assembly 60 not only protects the battery 61 from the elements but it also enables easy access to the battery 61 for repair or replacement via the access panel 64. The access panel 64 is a removable flat plate that is located along a side of the enclosure 62 to which it is affixed and sealed using a plurality of fasteners 70 and a perimeter edge gasket 65. The battery 61 and enclosure 62 are supported by the horizontal tray 66, which is a rigid rectangular platform shaped similar to the enclosure 62. The battery tray bracket 67 is a length of angle-shaped metal that is welded or otherwise permanently affixed to the bottom of the support tray 66. The support tray 66 in turn is affixed to the boat lifting structure 100 by a plurality of fasteners 70.

The solar panel 80 is an adjustable self-contained unit capable of charging the battery 61. The solar panel 80 includes a protective sealed plastic housing 82, a set of photovoltaic solar cells 84 which cover a front surface, and a molded-in, single axis swivel mount 86 along the rear surface. The swivel mount 86 allows azimuth adjustment. As such it is tightened in position via a fastener 70 such as a wing nut.

The side of the battery enclosure 62 supports a receiver 42 and its antenna 44. The receiver 42 and antenna 44 are preferably adhesively affixed, although other mounting methods may be used. The receiver 42 and antenna 44 are envisioned as being similar to those manufactured by SUPERWINCH® and other companies which provide remote activation of the winch assembly 20 upon receipt of a wireless signal 52 from a remote control device 46. The remote control device 46 is preferably a fob or similar hand-held signal transmitting structure. The receiver 42 and antenna 44 are in electrical communication with the control module 40 of the winch assembly 20 via wiring 105. This enables remote controlled actuation of the winch assembly 20. The remote control device 46 has a first button 48*a* to lower the boat lift 100, a second button 48*b* to raise the boat lift 100, and an attaching ring 50 which provides a convenient attachment of the remote control device 46 to a purse or other readily available item.

The control module 40 includes a housing which provides weatherproof protection to internal electrical and electronic equipment necessary for the operation of the solar-powered boat winch 10. The electrical and electronic equipment include, but is not limited to: a printed circuit board, microprocessors, memory chips, embedded software, a battery-charging circuit, relays, and the like. The control module 40 manages the power from the solar panel 80 to charge the battery 61. Additionally, the control module 40 provides software and hardware switching as required to direct power from the battery 61 to the motor 22 when directed by wired and wireless signals from the lift switch 28 and the remote control device 46, respectively (see FIG. 3).

FIG. 3 presents an electrical block diagram of the solar-powered boat winch 10. The control module 40 receives power from the solar panel 80 and uses it to charge the battery 61. The solar panel 80 includes at least one photovoltaic solar cell 84 and an integrated 12-volt regulator with a wattage rating capable of charging the battery 61. The battery 61 is preferably a deep-cycle, 12-volt marine-type unit designed to reliably operate over repeated discharge cycles. Power from the battery 61 is directed by the control module 40 to energize the motor 22 of the winch assembly 20 based upon input signals from the lift switch 28 and the remote control device 46. The remote control device 46 is a battery-operated hand-held unit in wireless communication with the antenna 44 and the receiver 42. They operate to allow remote controlled operation of the solar-powered boat winch 10. The remote control device 46 has the first button 48 and second button 48*b* which cause the motor 22 to rotate to lower or raise the boat lift 100.

The wireless signal 52 from the remote control device 46 is envisioned as a one-way signal. But, duplex communication might be incorporated for special purposes. It is envisioned that the signal 52 would be of a frequency modulated (FM) signal on a frequency authorized for such use. However, other methods of modulation such as amplitude modulation, single side band, digital, continuous wave and the like would also work. Thus the type of signal should not be construed as a limiting factor of the solar-powered boat winch 10.

It is envisioned that other styles and configurations of the present invention can be easily incorporated into the teachings of the present invention. While only one particular configuration was shown and described that was for purposes of clarity and disclosure and not by way of limitation of scope.

The preferred embodiment of the present invention can be utilized by the common user in a simple and effortless manner with little or no training. After initial purchase or acquisition of the solar-powered boat winch 10 it would be installed as indicated in FIGS. 1 and 2.

The method of installing and using the solar-powered boat winch 10 may be achieved by: removing an existing manual hand-crank winch from the existing cable-driven boat lift 100, if previously installed; installing the solar-powered boat winch 10 upon the boat lift 100, preferably at the location vacated by the manual winch, by attaching the first 92*a* and second 92*b* bracket ears of the winch bracket 90 to the boat lift 100 using fasteners 70; installing the battery 61 into the battery box assembly 60, if not previously installed, by removing fasteners 70 and access panel 64; connecting the terminal of the battery 61 to the wiring 105; inserting the battery 61 into the enclosure 62; replacing the access panel 64 using the fasteners 70; adjusting the swivel mount 86 of the solar panel 80 by loosening the fastener 70; pointing the solar cell 84 toward the sun; securing the solar panel 80 in position by tightening the fastener 70; allowing sufficient time for the solar panel 80 to charge the battery 61; connecting the cable 30 of the solar-powered boat winch 10 to various rigging members 102 of the existing boat lift 100; installing a fresh battery into the remote control device 46; lifting or lowering the boat lift 100 by actuating the winch assembly 20 either by pressing the lift switch 28 in a respective up or down direction, or by pressing the first 48*a* or second 48*b* button of the remote control device 46; holding down the switch 28 or button 48*a*, 48*b* to wind or release a length of cable 30 from the pulley 26 until the boat lift 100 is moved to a desired position; and benefiting from reduced effort and ease while lifting or lowering a boat lift 100 afforded a user of the solar-powered boat winch 10.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

What is claimed is:

1. A solar-powered boat winch, comprising:

a winch assembly having a gear reducer, an electric motor for rotating said gear reducer, and a gear pulley turned by said gear reducer;

a winch bracket attached to said winch assembly, said winch bracket configured to attach to an external structure using bolts that pass through apertures and into the external structure;

a battery for supplying electric power to said electric motor;

a switch for selectively switching electric power from said battery to said electric motor; and, a solar panel having a solar cell and a voltage regulator;

wherein said solar cell applies electrical power to said voltage regulator which in turn charges said battery.

2. The solar-powered boat winch according to claim 1, wherein said battery is within a battery box assembly having a protective enclosure.

3. The solar-powered boat winch according to claim 2, wherein said protective enclosure includes an access panel and a weather seal.

4. The solar-powered boat winch according to claim 3, wherein said battery box assembly is sealed.

5. The solar-powered boat winch according to claim 4, wherein said battery box assembly includes a support tray attached to a battery tray bracket that is configured to mount to an external structure.

6. The solar-powered boat winch according to claim 1, further including a cable wound on said gear pulley.

7. The solar-powered boat winch according to claim 6, further including at least one rigging receiving said cable.

8. The solar-powered boat winch according to claim 7, wherein said rigging receiving is a rigging pulley.

9. The solar-powered boat winch according to claim 1, wherein said switch supplies electric power to said electric motor to selectively rotate said electric motor in either direction.

10. The solar-powered boat winch according to claim 1, wherein said switch is a rocker switch.

11. The solar-powered boat winch according to claim 10, wherein said battery is a deep-cycle 12 volt battery.

12. The solar-powered boat winch according to claim 10, further including a remote control for remotely controlling said winch assembly.

13. The solar-powered boat winch according to claim 10, further including a control module for energizing said electric motor based on input from said switch or from said remote control.

14. The solar-powered boat winch according to claim 13, further including a receiver receiving signals from said remote control and for applying control signals to said control module.

15. The solar-powered boat winch according to claim 14, wherein said remote control is a fob.

16. The solar-powered boat winch according to claim 13, further including a battery enclosure holding said battery, wherein said receiver is affixed to said battery enclosure.

17. The solar-powered boat winch according to claim 1, further including a swivel mount holding said solar panel.

18. The solar-powered boat winch according to claim 1, wherein said winch bracket is welded to said gear reducer.

19. The solar-powered boat winch according to claim 1, wherein said winch bracket includes at least two first bracket ears configured to fit around an external structure.

20. The solar-powered boat winch according to claim 19, wherein a first bracket ear includes an aperture for receiving a fastener for attaching to the external structure.

* * * * *